United States Patent [19]

Uchida et al.

[11] Patent Number: 4,897,039

[45] Date of Patent: Jan. 30, 1990

[54] CONNECTOR LOCKING DEVICE

[75] Inventors: Kanzaburo Uchida; Tsunemi Eda, both of Mooka, Japan

[73] Assignee: Daiichi Denshi Kogyo Kabushiki Kaisha, Japan

[21] Appl. No.: 332,703

[22] Filed: Apr. 3, 1989

[30] Foreign Application Priority Data

Apr. 8, 1988 [JP] Japan ..... 63-47660[U]

[51] Int. Cl.[4] ..... H01R 13/62

[52] U.S. Cl. ..... 439/372; 439/345

[58] Field of Search ..... 439/345, 347, 350, 357, 439/358, 372

[56] References Cited

U.S. PATENT DOCUMENTS

| | | | |
|---|---|---|---|
| 2,944,864 | 7/1960 | Krivulka | 439/347 X |
| 4,556,270 | 12/1985 | Schutzle et al. | 439/372 X |
| 4,579,408 | 4/1986 | Sasaki | 439/372 X |
| 4,671,594 | 6/1987 | Ohtsuki et al. | 439/607 X |

*Primary Examiner*—Neil Abrams

*Assistant Examiner*—Khiem Nguyen

*Attorney, Agent, or Firm*—Silverman, Cass & Singer, Ltd.

[57] ABSTRACT

A locking device for a connector includes latch springs and latch supports for pivotally supporting the latch springs on a plate of connector. The latch support has an end face consisting of a series of a flat face perpendicular to a rotating axis of each of bent ends of the latch spring, a width differential face continuous to the flat face and obliquely protruding in an axial direction of the bent end of the latch spring away from the flat face, and a gently inclined face continuous to the width differential face on opposite side of the flat face and obliquely depressing in an axial direction of the bent end of the latch spring away from the width differential face. Base portions of the latch spring are in contact with the flat faces, in contact with the width differential faces and in contact with the gently inclined faces, when the latch spring is in a vertical, a predetermined inclined and a horizontal position, respectively.

7 Claims, 10 Drawing Sheets

38
30

30
38
36
34
32
IVc
IVb
IVd
(Inward Side)
y
54
x (Rearward Side)
(Outward Side)
(Forward Side)

30
36
34

30

FIG_5b
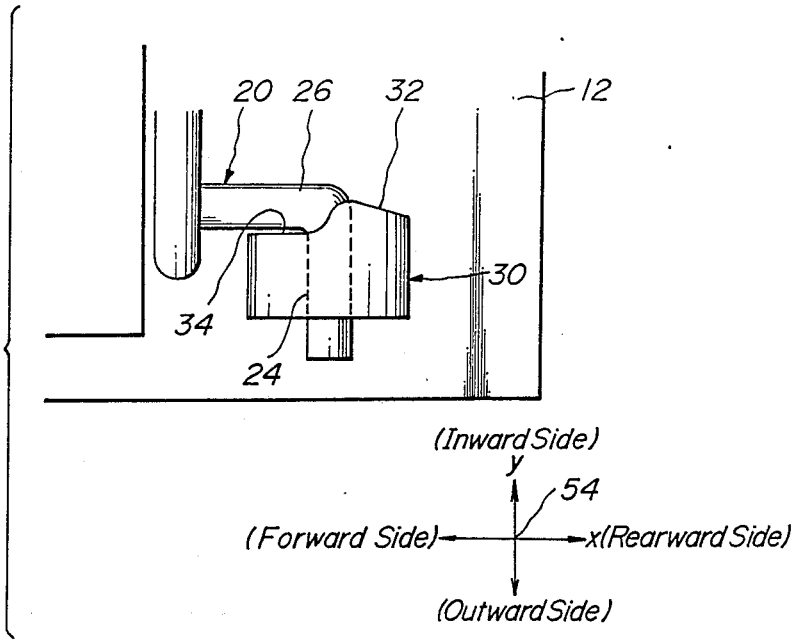
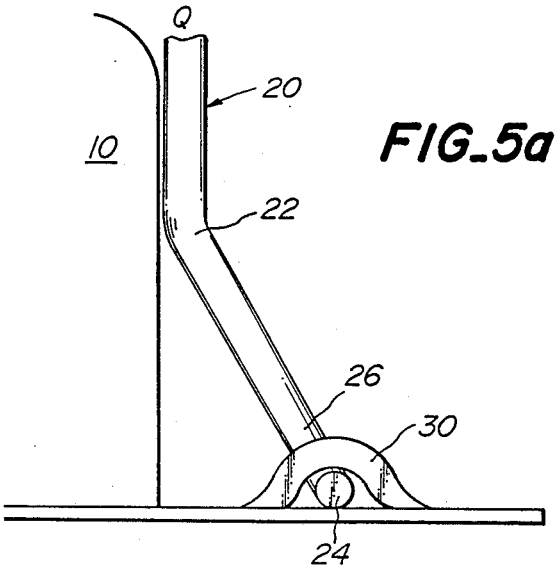
FIG_5a

CONNECTOR LOCKING DEVICE

BACKGROUND OF THE INVENTION

This invention relates to a locking device using a loop-shaped latch spring to be applied to a rectangular electronic connector (typically standardized in EIA-232D of EIA or Electronic Industries Association) whose size is of the order of ones mounted on a back of an electronic appliance, for example, a personal computer for connecting the computer to peripheral equipment, and more particularly an improvement of latch supports for latch springs of a connector.

First, requirements to such latch springs will be explained.

(1) In general, during shipment and transportation, connectors are piled with latch springs 20 in horizontal positions as shown in FIG. 8 to advantageously reduce spaces for piling. It is therefore required that the latch springs are stably stationary in the horizontal positions (P in FIG. 9). In FIGS. 8 and 9, the latch springs 20 are pivotally connected to a connector 10 at latch supports 30.

(2) Moreover, connectors of this kind are often fixed to panels of appliances. In such case, the latch springs 20 are sometimes required to be stably stationary in vertical positions (Q in FIG. 9) owing to a requirement resulting from a relation to a mounting aperture 52 of the panel 50 as shown in FIG. 10.

(3) In case of the latch springs being used as locking means for a connector, the latch springs 20 are in inclined positions as shown in FIG. 11 and need to be kept to prevent from rotating from the inclined positions to horizontal positions in order to facilitate engagement with a mating connector.

In other words, the latch springs need to be maintained at inclined positions at a predetermined angle (R in FIG. 9).

(4) In order to secure the connector 10 to the panel 50 shown in FIG. 10, the latch springs 20 are manually forced to rotate toward the vertical positions with their free ends. In this case, it is preferable for saving steps of mounting process that after the latch springs have been rotated through certain angles before arriving at the vertical positions (Q in FIG. 9), the latch springs can rotate by themselves or automatically to the vertical positions without requiring further urging forces by hands. On the other hands, it is of course better that the latch springs are caused to be snugly positioned in the desired vertical positions without being rotated too far. In case of the latch spring being rotated too far, they must be returned into opposite directions.

(5) The above requirements are summarized as follows.

1. The latch springs must be stably stationary in horizontal positions (P in FIG. 9).
2. The latch springs must be stably stationary in vertical positions (Q in FIG. 9).
3. The latch springs must be stably stationary in predetermined inclined positions (R in FIG. 9).
4. The latch springs must be automatically forced to rotate from the horizontal positions P to the vertical positions Q, but must not be forced in movement from the vertical positions Q to the inclined positions R.

FIGS. 1*a* and 1*b* illustrate a latch spring of the prior art. The latch spring 20 has pivotal ends 24 which are inserted in half-cylindrical support portions 30. End faces of the support portions 30 on which the latch springs slide are flat and in parallel with sliding directions of the latch springs.

With such an arrangement, the latch springs 20 are not subjected to any automatic action to rotate toward the desired vertical positions during rotations and forces for restraining the latch springs 20 are only frictional forces which are uniform and caused in areas of the support portions 30 in which the latch springs 20 rotate.

In consideration of the above requirements, the latch springs 20 of the prior art do not fulfill the requirement (4), because they are not subjected to the automatic action. Moreover, the latch springs stop in inclined positions, but they are not particularly stably stationary in such positions in comparison with other inclined positions. Therefore, the latch springs of the prior art do not fulfill the requirement (3) either.

FIGS. 2*a* and 2*b* illustrate another latch spring of the prior art. With the latch spring, support portions 30 are formed with notches 31. Therefore, the latch spring 20 falls into the notches 31 at the midway of their rotations so that the latch spring 20 rests stably in inclined positions determined by the notches 31 of the support portions 30.

However, the latch spring 20 is not stably stationary in positions other than the inclined positions determined by the notches 31, because the latch spring 20 is always urged into the notches 31. Therefore, the latch springs 20 of the second prior art do not fulfill the requirements (1) and (2). Moreover, they of course do not fulfill the requirement (4).

SUMMARY OF THE INVENTION

It is an object of the invention to provide an improved locking device for a connector which eliminates all the disadvantages of the prior art and enables latch springs to be rotated by an automatic action by a particular configuration of latch supports for the latch springs.

In order to achieve the object of the invention, in a locking device for a connector including latch supports in the form of a half-cylinder and latch springs, horizontally outwardly bent ends of each of the latch springs being rotatably supported in two latch supports, respectively, and base portions of each of the latch springs being always in elastic contact with end faces of two latch supports, according to the invention an end face of each of the latch supports comprises a flat face substantially perpendicular to rotating axes of the bent ends of the latch spring, a width differential face made of an inclined face continuous to the flat face and obliquely protruding in an axial direction of the bent ends of the latch spring away from the flat face, and a gently inclined face continuous to the width differential face on an opposite side of the flat face and obliquely depressing in an axial direction of the bent ends of the latch spring away from the width differential face, and said base portions of each of the latch springs are in contact with said flat faces, in contact with the width differential faces, and in contact with the gently inclined faces when the latch spring is in a vertical, a predetermined inclined and a horizontal position, respectively.

The invention will be more fully understood by referring to the following detailed specification and claims taken in connection with the appended drawings.

BRIEF DESCRIPTION OF THE DRAWINGS

FIGS. 5*a* and 5*b* are a side view of a latch spring in a vertical position and a plan view illustrating a relation between the latch support and the latch spring in the vertical position;

DETAILED DESCRIPTION OF THE PREFERRED EMBODIMENTS

Figure 1A:
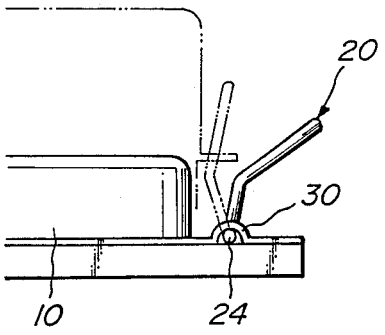
FIG. 1a PRIOR ART
FIGS. 1*a* and 1*b* are a side and a plan view of a device of the prior art.
Figure 1B:
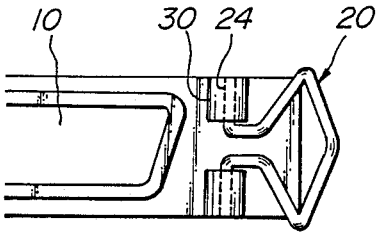
FIG. 1b PRIOR ART
Figure 2A:
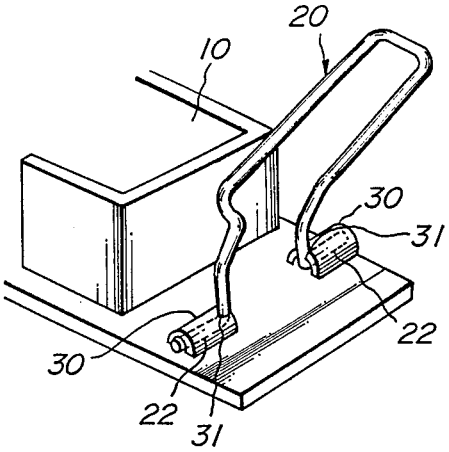
FIG. 2a PRIOR ART
FIGS. 2*a* and 2*b* are a perspective and an explanatory view of another device of the prior art.
Figure 2B:
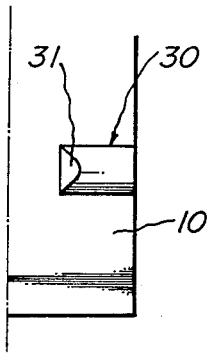
FIG. 2b PRIOR ART
Figure 3A:
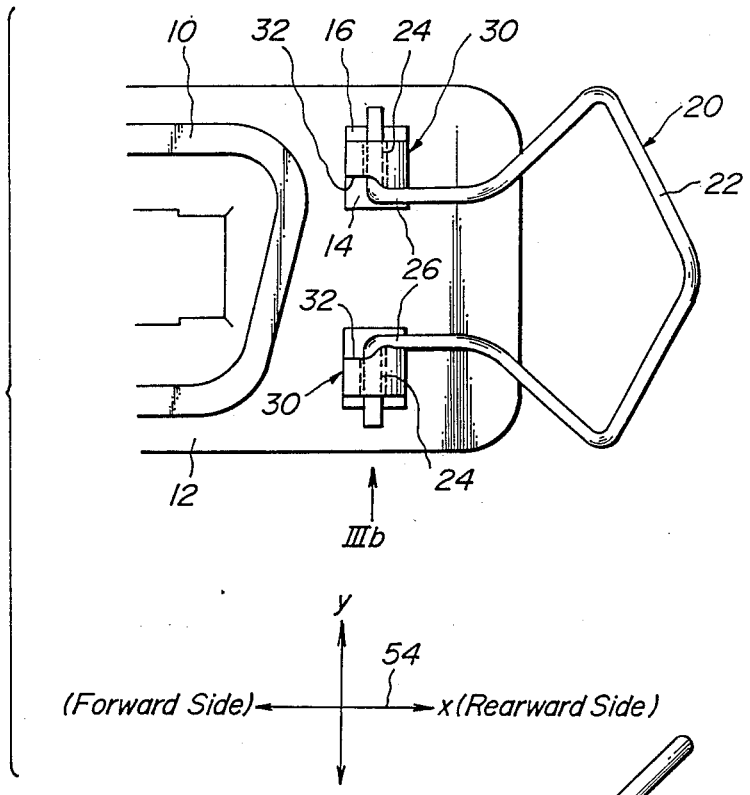
FIGS. 3*a* and 3*b* are a plan and a side view of the device according to the invention.
Figure 3B:
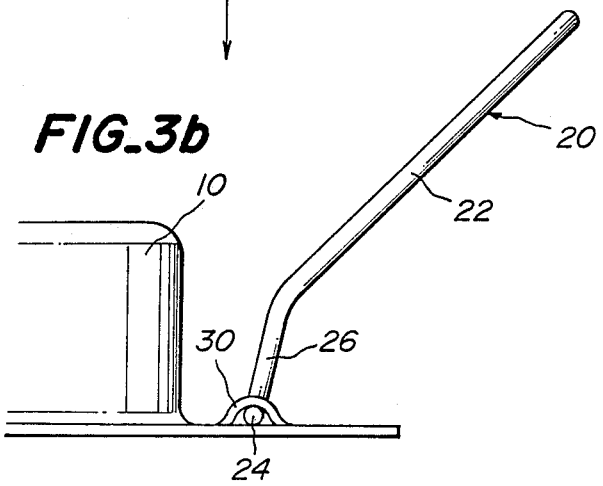

One embodiment of the invention is shown in FIGS. 3*a* and 3*b* which are a plan view and a side view shown in a direction shown by an arrow III*b* in FIG. 3*a*. A latch spring 20 in this embodiment is made of a stainless steel, whose horizontally bent ends 24 are rotatably supported in latch supports 30 in the form of a half-ring or cylinder. The latch spring 20 has base portions 26 which are always in elastic contact with end faces 32 of the latch supports 30.

According to the invention, the end faces 32 of the latch supports 30 in contact with the latch springs 20 are novel in configuration, but the latch springs 20 are similar to those of the prior art.

Moreover, the latch supports 30 in this embodiment are stamped upwardly from a plate 12 of a connector 10 by pressing. Reference numerals 14 and illustrate apertures formed in the plate 12 as a result of the formed latch supports 30. The single latch support 30 is illustrated in FIG. 4*a* which is a plan view and FIGS. 4*b*, 4*c* and 4*d* which are side views seen in directions of IV*b*, IV*c* and IV*d* in FIG. 4*a*.

In order to clarify directions of operation of the latch springs, FIG. 3*a* includes directions x which intersect rotating axes of the horizontally bent ends 24 of the latch spring 20 pivotally supported in the latch supports 30 and are in parallel with a plane of the plate 12 and directions y which are of the directions of the rotating axes of the bent ends 24 of the latch bent ends 24 (arrows 54 in FIG. 3*a*).

Figures 4A, 4B, 4C, 4D:
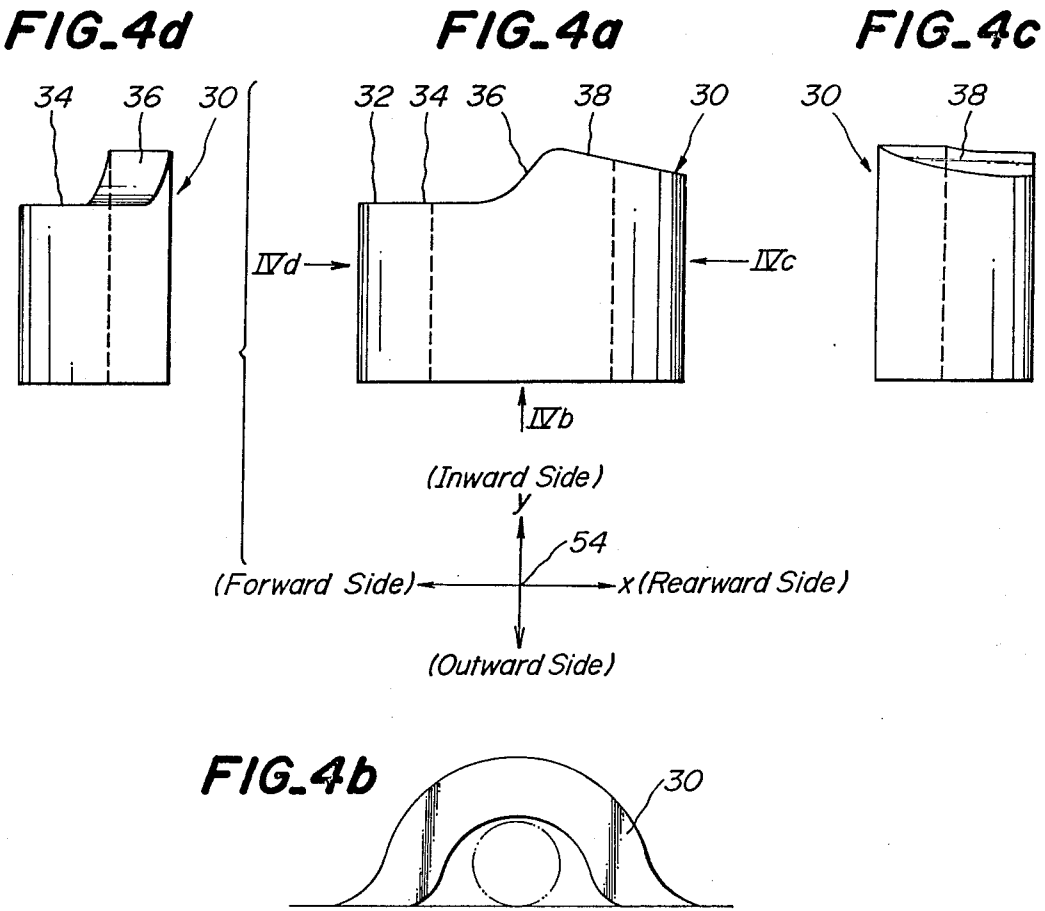
FIGS. 4*a*, 4*b*, 4*c* and 4*d* are a plan, a front, and a right side and a left side view of a latch support used for the invention.
Figure 6B:
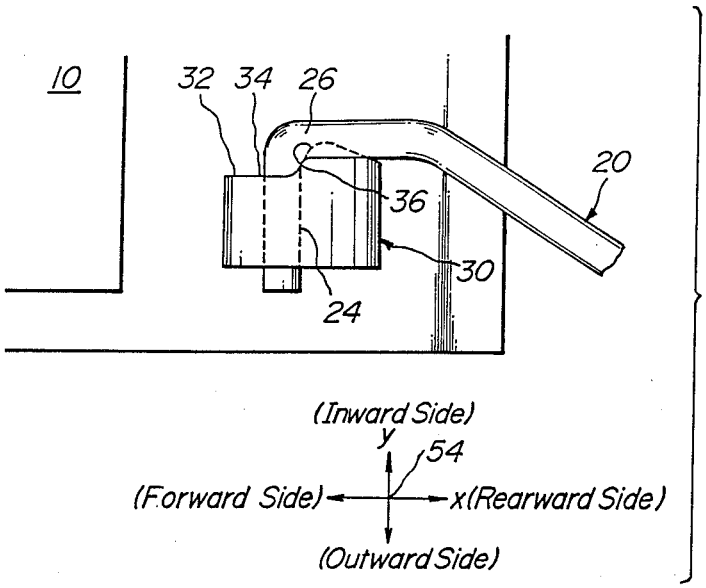
FIGS. 6*a* and 6*b* are a side view of the latch spring in an inclined position and a plan view illustrating a relation between the latch support and the latch spring in the inclined position.
Figure 6A:
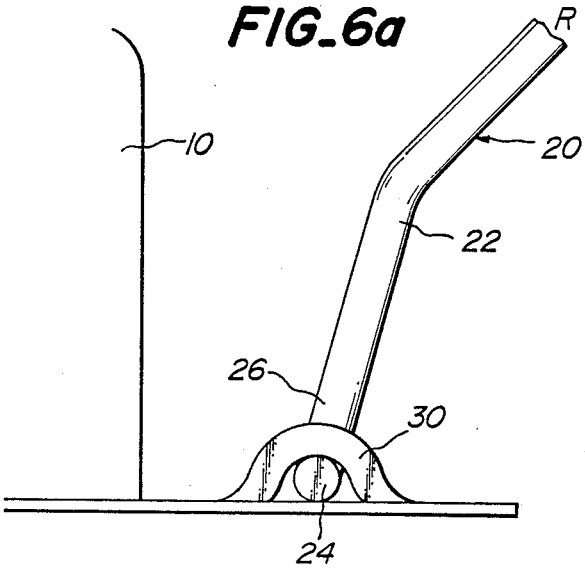

In this embodiment, a diameter of a wire forming the latch spring is approximately 1 mm and apertures of the latch supports for receiving the horizontally bent ends 24 of the latch spring 20 are formed so as to permit a cylinder having an outer diameter of 1.2 mm to inscribe in the apertures (FIG. 4*b*). The plate 12 of the connector 10 is of 0.5 mm in thickness.

A configuration of the end face of the latch support 30 is formed as follows.

Figure 12A:
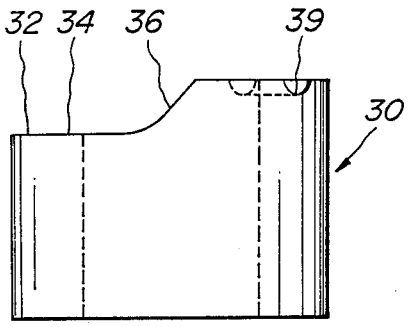
FIGS. 12*a*, 12*b* and 12*c* illustrate a latch support having a concave face according to the invention.
Figure 12C:
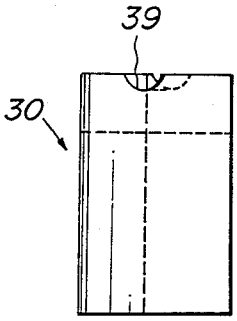
Figure 12B:
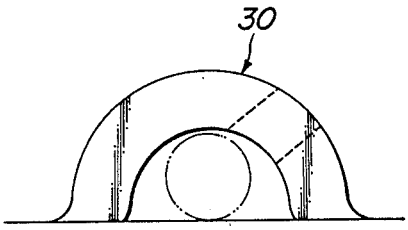

1. An inward end face 34 is facing to the direction y and in opposition to the similar face 34 of a mating latch support. The inward end face 34 is a flat which is not inclined to the directions x.
2. Continuous to the flat end face 34 on a rear side in the direction x is formed a width differential face 36 which consists of an inclined surface progressively extending inwardly in the y direction as it extends onto the rearward side. In this case, the rearward side is that of the end of the plate 12 where the relevant latch springs are provided. A forward side is that of the other end of the plate 12 opposite to the rearward side.
3. Continuous to the width differential face 36 on the rearward side in the direction x is formed a slowly or gently inclined face 38 (or a recess 39 shown in FIGS. 12*a* and 12*b*) retracting on the outward side as it extends onto the rearward side in the x direction. A height of the gently inclined face 38 is at the most equal to a height of the width differential face 36 from the flat face 34.

Figure 9:
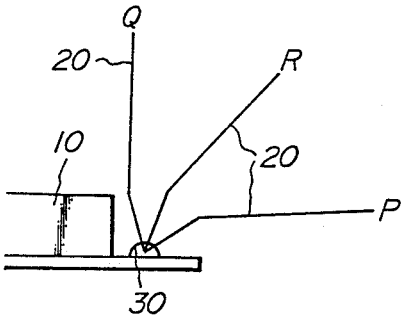
FIG. 9 is an explanatory view of positions of a latch spring.

According to the invention, moreover, the relation between the base portion 26 of the latch spring 20 and the end face 32 of the latch support 30 is determined in the following manner when the latch spring is in a vertical position Q (1), a predetermined inclined (for example 45°) position R (2), and a horizontal position P (3), respectively, in FIG. 9.

(1) When the latch spring 20 is in the vertical position, the base portions 26 of the latch spring 20 are adapted to be in contact with the flat faces 34 of the end faces 32 of the latch supports 30 as shown in FIGS. 5*a* and 5*b*.

In general, a main body 22 of a latch spring 20 is bent as shown in FIG. 3*a*. Therefore, contacting portions between the base portions 26 and the end faces 32 of the latch supports 30 are positioned at locations slightly shifted forwardly from a center of the end face 32 in the direction x (refer to the arrow 54). If the latch spring 20 is straight without being bent, the contacting portions between the base portions 26 and the end faces 32 of the latch supports 30 are located at the centers of the end faces 32 in the direction x. The contacting portions of the base portions 26 and the end faces 32 are thus located in various positions dependent upon the configuration of the latch springs 20. Therefore, use is particularly made in this specification of the expression "sliding contacting portion" between the latch supports and the base portions 26 of the latch spring 20.

(2) When the latch spring 20 is in the 45° inclined position, the base portions 26 of the latch spring 20 are adapted to be in contact with the width differential faces 36. The width differential faces 36 are located at centers of sliding portions between the latch spring 20 and the end faces 32.

Figure 7B:
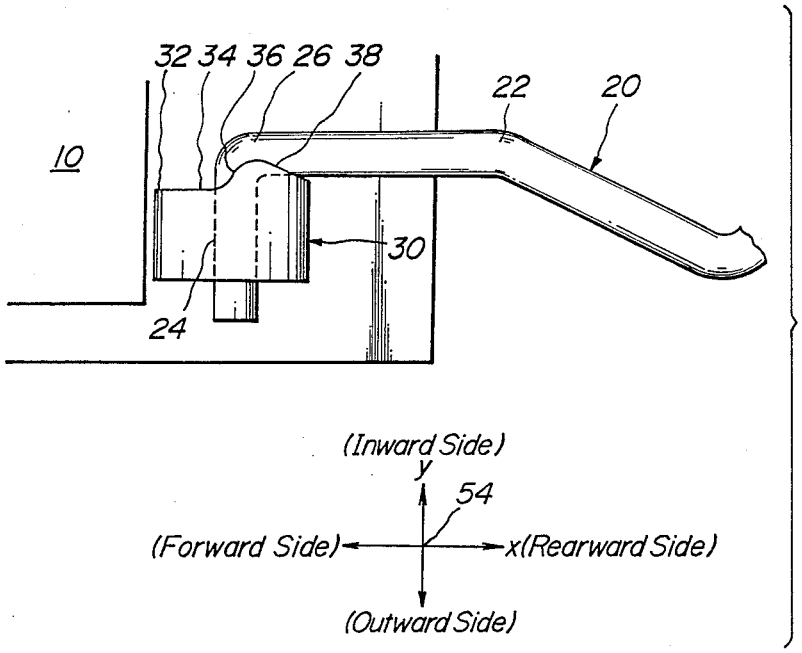
FIGS. 7*a* and 7*b* are a side view of the latch spring in a horizontal position and a plan view illustrating a relation between the latch support and the latch spring in the horizontal position.
Figure 7A:
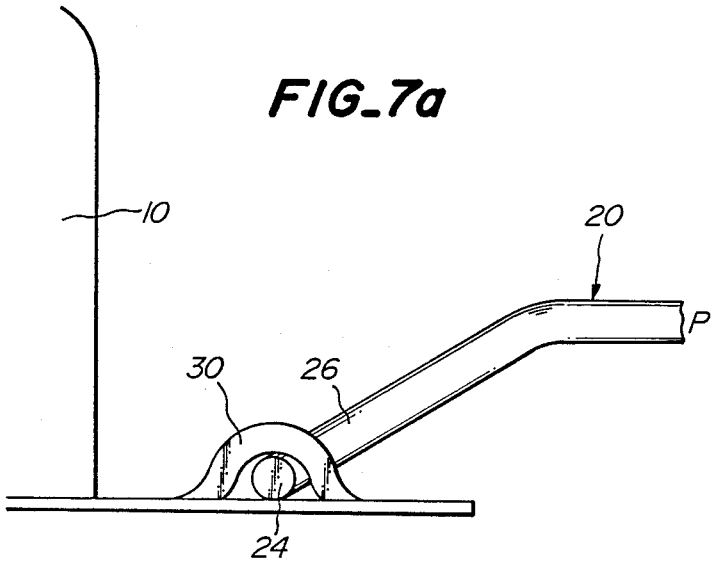
Figure 8:
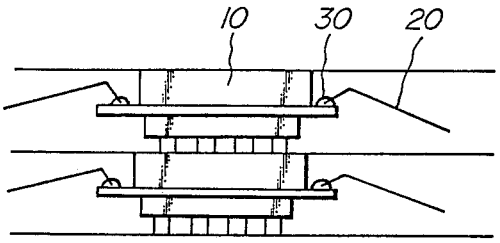
FIGS. 8, 10 and 11 are schematic views for explaining requirements for latch springs.

(3) When the latch spring 20 is in the horizontal position, the base portions 26 of the latch spring 20 are adapted to be in contact with the gently inclined faces 38 as shown in FIGS. 7*a* and 7*b*. The face 38 may be formed with the recess 39 instead of being inclined. The recess 39 includes a circular arc matching a curve of the latch spring. A depth of the recess 39 is equal to or less than the height of the width differential face 36 from the flat face 34.

In this embodiment, the latch support has an axial length of about 3 mm in the direction y, and has the width differential face 36 whose height from the flat face 34 is approximately 1 mm preferably within a range from one half of a diameter of a wire of the latch spring to the diameter of the wire and whose angle relative to the flat face 34 is about 50°. The inclined angle of the width differential face 36 relative to the flat face 34 may be less than 45° for effective operations thereof, so long as a coefficient of friction between the latch spring 20 and the latch supports 30 is made as little as possible. Moreover, the inclined angle of the width differential face 36 may be more than 90°, if the base portions 26 of the latch spring 20 could ride over the width differential faces 36.

The device according to the invention functions as follows.

(1) When the latch spring 20 according to the invention is in the horizontal position, it settles on the gently inclined faces 38 (or recesses 39) in a stably stationary condition. Therefore, the above requirement (1) is fulfilled.

(2) When the latch spring 20 is forced from the horizontal position to the vertical position, the base portions 26 of the latch spring 20 slide on the width differential faces 36 and arrive at peaks thereof. Thereafter, the base portions 26 of the latch spring 20 ride over the peaks and slide down along the width differential faces 36 to arrive at the flat faces 34. The latch spring 20 can arrive in the vertical position at once in this manner while being forced by the configuration of the end faces of the latch supports 30.

Such an operation of the latch spring 20 is more readily and securely effected when the bent ends 24 of the latch spring 20 are loosely supported in the latch supports 30. In other words, it is preferable to provide play between the bent ends of the latch spring 20 and the latch supports 30.

The latch spring 20 is stably stationary in the vertical position. Therefore, the requirements (2) and (4) are fulfilled.

(3) When the latch spring 20 is forced from the vertical position to the horizontal position, the base portions 26 of the latch spring 20 slide on the flat faces 34 and abut against the width differential faces 36 at a moment when the latch spring 20 has been rotated through a predetermined angle for example 45°. The latch spring 20 is thus stopped and a further rotation of the latch spring 20 is restrained for the time being. Therefore, the requirement (3) is fulfilled.

(4) When a further rotating force is applied to the latch spring 20 whose base portions 26 are restrained at the width differential faces 36, the latch spring 20 ride over the width differential faces 36 and arrives in the horizontal position where the latch spring 20 is stably stationary.

As can be seen from the above explanation, the device according to the invention fulfill all the requirements above described. As a result, the handling of the connector becomes easier during a series of handling processes.

Figure 10:
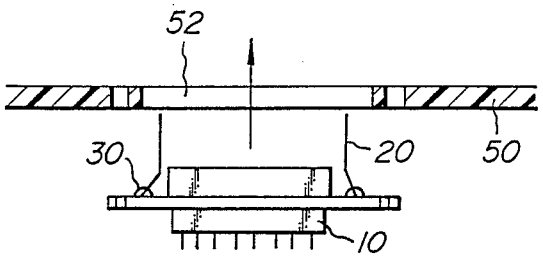
Figure 11:
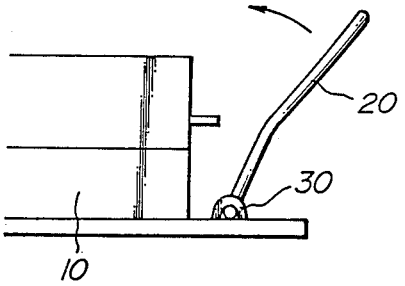

In the rotation of the latch spring from the horizontal position to the vertical position, particularly, the automatic action is applied to the latch spring by the width differential faces 36 so that the latch spring 20 can be rotated by one simple manual operation. Therefore, mounting of connectors on panels (refer to FIG. 10) is readily effected and the latch springs are easily operated for shipment and storage of connectors.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A locking device for a connector including latch supports in the form of a half-cylinder and latch springs, horizontally outwardly bent ends of each of the latch springs being rotatably supported in two latch supports, respectively, and base portions of each of the latch springs being always in elastic contact with end faces of two latch supports, wherein an end face of each of the latch supports comprises a flat face substantially perpendicular to rotating axes of the bent ends of the latch spring, a width differential face made of an inclined face continuous to the flat face and obliquely protruding in an axial direction of the bent ends of the latch spring away from the flat face, and a gently inclined face continuous to the width differential face on an opposite side of the flat face and obliquely depressing in an axial direction of the bent ends of the latch spring away from the width differential face, and said base portions of each of the latch springs are in contact with said flat faces, in contact with the width differential faces, and in contact with the gently inclined faces when the latch spring is in a vertical, a predetermined inclined and a horizontal position, respectively.

2. A locking device as set forth in claim 1, wherein said width differential faces are located substantially at centers of sliding portions between the latch spring and the end faces of the latch supports.

3. A locking device as set forth in claim 1, wherein a height of the width differential face from the flat face is within a range of one half of a diameter of a wire of the latch spring to equal to the diameter.

4. A locking device as set forth in claim 1, wherein an inclined angle of the width differential face with an extension of the flat face extending onto the width differential face is within a range of 45° to 90°.

5. A locking device as set forth in claim 1, wherein a height of the gently inclined face is at the most equal to a height of the width differential face from the flat face.

6. A locking device as set forth in claim 1, wherein said gently inclined face is not inclined and is formed with a recess.

7. A locking device as set forth in claim 6, wherein said recess includes a circular arc matching with a curve of the latch spring, and a depth of the recess is at the most equal to a height of the width differential face from the flat face.

* * * * *